US007330534B2

(12) United States Patent
Li et al.

(10) Patent No.: US 7,330,534 B2
(45) Date of Patent: Feb. 12, 2008

(54) RAY BEAM GUIDING APPARATUS AND RAY INSPECTION SYSTEM HAVING THE SAME

(75) Inventors: Yulan Li, Beijing (CN); Yuanjing Li, Beijing (CN); Zhiqiang Chen, Beijing (CN); Yinong Liu, Beijing (CN); Qitian Miao, Beijing (CN); Wanlong Wu, Beijing (CN); Ziran Zhao, Beijing (CN); Xilei Luo, Beijing (CN); Li Zhang, Bejing (CN); Bin Sang, Beijing (CN); Hailin Wang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 0 days.

(21) Appl. No.: 11/523,745

(22) Filed: Sep. 19, 2006

(65) Prior Publication Data

US 2007/0064875 A1 Mar. 22, 2007

(30) Foreign Application Priority Data

Sep. 22, 2005 (CN) ..... 2005 1 0086455

(51) Int. Cl.
*G21K 1/00* (2006.01)
*G21K 1/02* (2006.01)
*G21K 1/04* (2006.01)

(52) U.S. Cl. ..... 378/145; 378/147; 378/150

(58) Field of Classification Search ..... 378/145–160
See application file for complete search history.

(56) References Cited

U.S. PATENT DOCUMENTS 4,905,268 A * 2/1990 Mattson et al. ..... 378/158
5,012,506 A * 4/1991 Span et al. ..... 378/152
5,757,881 A * 5/1998 Hughes ..... 378/65
5,844,962 A * 12/1998 Kunert ..... 378/150
6,320,936 B1 * 11/2001 Holland et al. ..... 378/140
6,850,596 B2 * 2/2005 Sundermann et al. ..... 378/147
7,106,831 B2 * 9/2006 Li ..... 378/152

OTHER PUBLICATIONS

"Patents Act 1977/Combined Search and Examination Report under Sections 17 and 18 (3)" from The Patent Office for Application No. GB0618337.0, date of report Jan. 22, 2007; 2 pages.

* cited by examiner

*Primary Examiner*—Courtney Thomas
*Assistant Examiner*—Irakli Kiknadze
(74) *Attorney, Agent, or Firm*—Westman, Champlin & Kelly, P.A.

(57) ABSTRACT

The present invention discloses a ray beam guiding apparatus, comprising a ray beam guiding box having substantially fan-shaped top and bottom surfaces, defining an inner space, and having open wide and narrow ends; an engaging member joined to the narrow end of the box; a first collimator mounted to the box adjacent to the narrow end for adjusting size/shape of the ray beam in horizontal vertical direction; a second collimator having a calibration slit or grill and mounted to the box adjacent to the wide end; and an adjusting member connecting the engaging member and a ray generator to adjust a distance therebetween. The box can adjust size/shape and centering of the ray beam, so that inspection quality can be improved and thickness of the ray shielding layer can be reduced, the box is applicable to a ray inspection system which performs security inspection of liquid articles.

7 Claims, 2 Drawing Sheets

RAY BEAM GUIDING APPARATUS AND RAY INSPECTION SYSTEM HAVING THE SAME

BACKGROUND OF THE INVENTION

The present application is claims priority of Chinese patent application Serial No. 200510086455.0, filed Sep. 22, 2005, the content of which is hereby incorporated by reference in its entirety.

1. Technical Field of the Invention

The present invention generally relates to a ray inspection system for making safety inspection of articles, such as a liquid articles, by using rays, more particularly, to a ray beam guiding apparatus.

2. Description of the Related Art

In conventional ray inspection systems, X-rays are generated by using an X-ray tube. When electrons strike onto a tungsten target at an accelerative speed under a high voltage between the anode and cathode of the X-ray tube, X-rays are generated.

Generally, an X-ray beam is emitted from a focal spot and in the form of conic shape. The profile (e.g. size and/or shape) of the X-ray beam should be limited to different forms according to its different applications. In the prior art, the profile or contour of the X-ray beam is limited by using a collimator for changing the X-ray beam into a line shape, a collimator for changing the X-ray beam into a rectangular shape, or combinations thereof.

The conventional ray beam guiding apparatus for limiting the X-ray beam to a substantial fan shape can neither change accurately width of the ray beam and nor adjust conveniently centering of the ray beam. Therefore, the X-rays tend to be deflected and scattered, so that the inspection quality is deteriorated and the thickness of the ray shielding layer inside the guiding apparatus is needed to be increased.

SUMMARY OF THE INVENTION

An aspect of the present invention is to solve all or at least parts of the above problems occurring in the prior art.

According to a first aspect of the present invention, there is provided a ray beam guiding apparatus provided integrally with first and second collimators.

The ray beam guiding apparatus according to the embodiments of the present invention can adjust not only the profile (e.g. sizes, and shapes) of the ray beam but also centering of the ray beam relative to the detector array, so that the inspection quality can be improved and the thickness of the ray shielding layer inside the ray beam guiding apparatus can be reduced. The ray beam guiding apparatus according to the present invention is applicable to a ray inspection system for making security inspection of liquid matters.

The ray beam guiding apparatus according to a first aspect of the present invention comprises: a ray beam guiding box which has substantially fan-shaped top and bottom surfaces, defines an inner space, and has open wide and narrow ends; an engaging member joined to the narrow end of the ray beam guiding box; a first collimator mounted to the ray beam guiding box adjacent to the narrow end for adjusting a profile of the ray beam in a first direction and a second direction perpendicular to the first direction; a second collimator having a calibration slit or grill and mounted to the ray beam guiding box adjacent to the wide end; and an adjusting member connecting the engaging member and a ray generator for emitting rays for adjusting a distance between the ray generator and the ray beam guiding box.

The ray beam guiding box comprises a lower box body, including a substantially fan-shaped bottom plate, first and second side plates extending upwardly from two sides of the bottom plate and perpendicular to the bottom plate, and an extension plate portion extending from the wide end of the ray beam guiding box and lying in the same plane as that of the bottom plate, in which a detector support with a detector array is disposed on the extension plate portion; and an upper cover covering a top of the lower box body.

According to an embodiment of the invention, a ray shielding layer is disposed inside the ray beam guiding box, and a through aperture is formed at a substantial center of the ray beam guiding box so as to penetrate through the bottom plate and the upper cover.

Further, the ray beam guiding apparatus further comprises: a first boss disposed on the bottom plate adjacent to the narrow end, for engaging and mounting a first calibration member having a calibration slit; a second boss disposed on the bottom plate adjacent to the wide end, for engaging a second calibration member having a calibration slit, in which the through aperture is located between the first and second bosses and the first and second calibration members are cooperated to calibrate the ray beam emitted from the ray generator and passing through the ray beam guiding box; and a third boss disposed on the extension plate portion the detector support and adjust a distance between the detector support and a target spot of the ray generator, wherein the detector support has a support body and a detector arm moveable with respect to the support body.

According to an embodiment of the invention, the first collimator comprises: first and second sliding stoppers which are engaged in a first slide groove formed in the ray beam guiding box, and slidable along the first slide groove in the first direction so as to adjust a first distance therebetween; and third and forth sliding stoppers which are engaged in a second slide groove formed in the ray beam guiding box, and slidable along the second slide groove in the second direction so as to adjust a second distance therebetween.

In addition, the first collimator further comprises; a first graduator connected to the first and second sliding stoppers to adjust sliding of the first and second sliding stoppers along the first slide groove; and a second graduator connected the third and forth sliding stoppers to adjust sliding of the third and forth sliding stoppers along the second slide groove.

Further, the ray beam guiding apparatus further comprises: a first adjusting screw disposed on the adjusting plate to adjust a position of the ray generator with respect to the ray beam guiding box in the first direction; and a second adjusting screw disposed on the adjusting plate to adjust a position of the ray generator with respect to the ray beam guiding box in the second direction.

According to second aspect of the invention, there is provided a ray inspection system comprising the ray beam guiding box according to the first aspect of the invention.

According to a second aspect of the present invention, there is provided a ray inspection system comprising the ray beam guiding apparatus according to a first aspect of the present invention.

With the ray beam guiding apparatus having the above mentioned structures, the following advantages can be achieved with the present invention.

1. The field angle of the ray beam can be controlled easily and effectively.

2. It is possible to adjust the width and height (i.e. sizes in the horizontal and vertical directions) of the ray beam.

3. It is easy to center the target spot of the ray generator (ray source).

4. The thickness of the ray shielding layer of the ray beam guiding apparatus can be reduced, with the inspection quality improved as well.

5. The ray beam guiding apparatus of the present application is applicable to a ray inspection system, particularly to a ray inspection system for performing security inspection of liquid articles.

DETAILED DESCRIPTION OF THE PREFERRED EMBODIMENTS OF THE INVENTION

Figure 1:
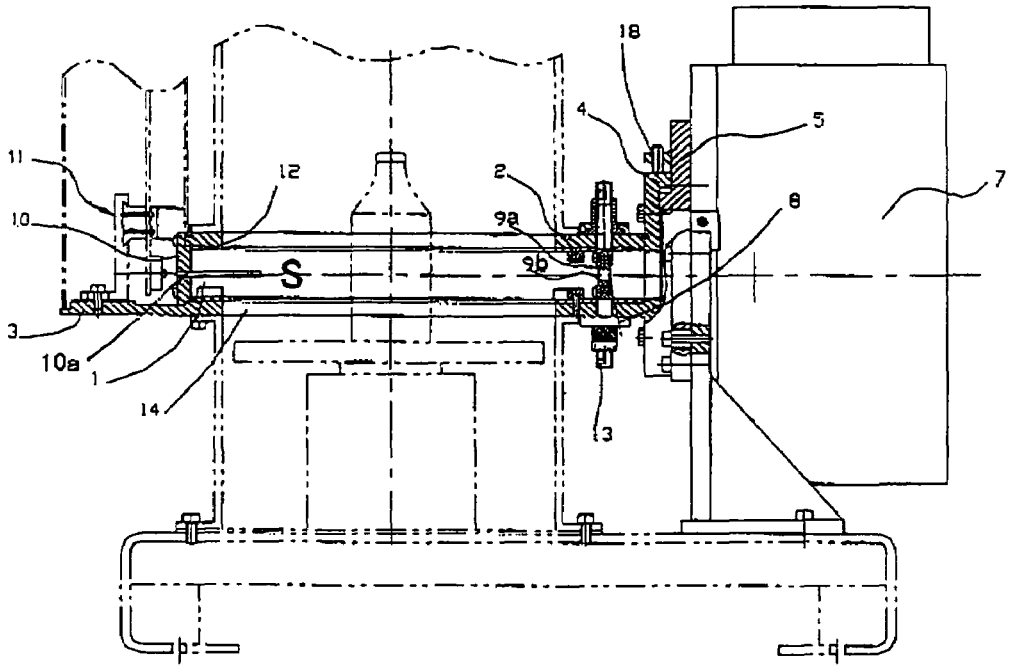
FIG. 1 is a schematic view showing the overall structure and the application state of the ray beam guiding apparatus according to an embodiment of the present invention.

Embodiments of the present invention will be described in detail with reference to drawings, the same elements are denoted by like reference numerals throughout the descriptions. The embodiments described herein are explanatory and illustrative and shall not be construed to limit the present invention.

Figure 2:
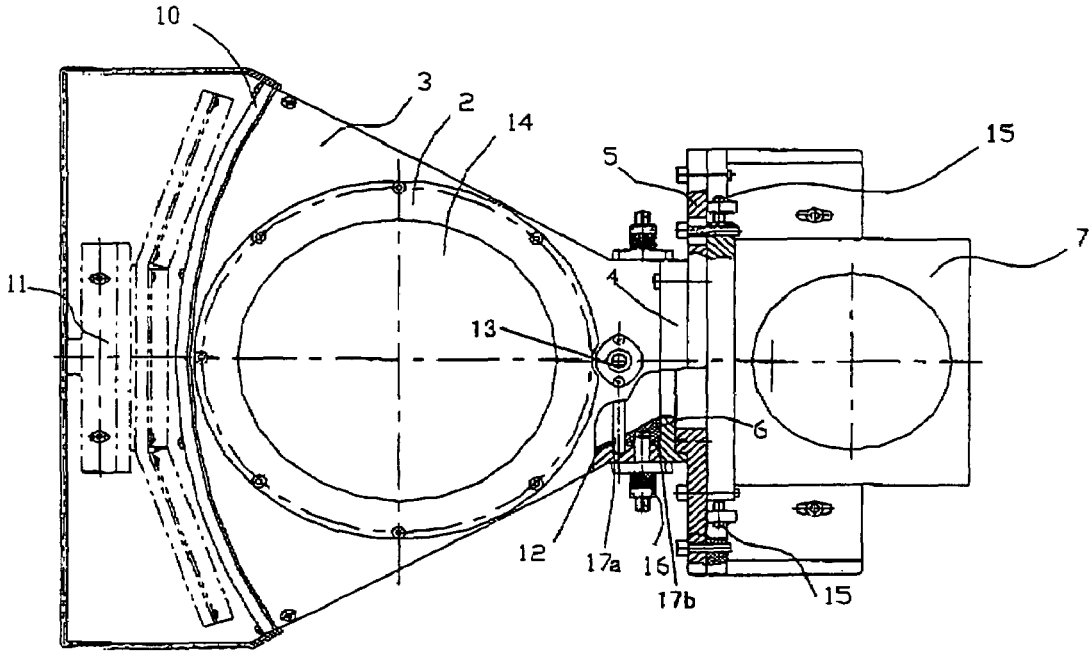
FIG. 2 is a partially sectional top view of FIG. 1.
Figure 3:
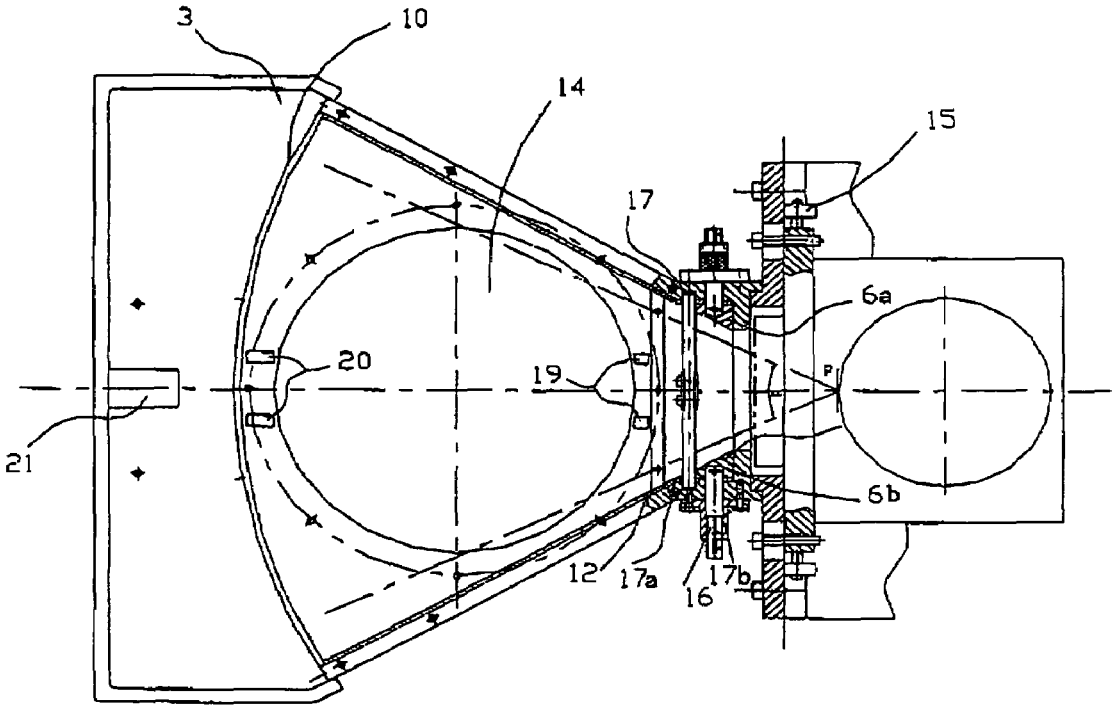
FIG. 3 is a view showing the structure of the lower box body of the ray beam guiding apparatus.

As shown in FIGS. 1 to 3, the ray beam guiding apparatus according to an embodiment of the present application comprises a ray beam guiding box 1, a first collimator 8 (right collimator in FIGS. 1-3), a second collimator 10 (left collimator in FIGS. 1-3), an engaging member/plate 4, and an adjusting member/plate 5.

The ray beam guiding box 1 defines an inner space S, and has substantially fan-shaped top and bottom surfaces as well as an open wide end (left end in FIGS. 1-4) and an open narrow end (right end in FIGS. 1-4). The engaging plate 4 is joined to the narrow end of the ray beam guiding box 1, and the adjusting plate 5 connects the engaging plate 4 with a ray generator (ray source) 7 and is adapted to adjust a distance between the ray generator 7 and the ray beam guiding box 1.

The first collimator 8, adaptable to adjust sizes and/or shapes (i.e. contour) of the ray beam in first and second directions (e.g. in horizontal and vertical directions in FIG. 1), is mounted to a narrow end portion (right side end in FIG. 1) of the ray beam guiding box 1, that is, the first collimator 8 is mounted to the ray beam guiding box 1 so as to be adjacent to the narrow end. The second collimator 10 having a calibration slit or grill 10*a* is mounted to a wide end portion (left side end in FIG. 1) of the ray beam guiding box 1, that is, the second collimator 10 is mounted to the ray beam guiding box 1 so as to be adjacent to the wide end. In FIG. 1, the calibration slit or grill 10*a* is shown as a horizontal slit.

More particularly, the ray beam guiding box 1 comprises a lower box body 3 and an upper cover 2 for covering a top of the lower box body 3, thus defining the inner space S. The lower box body 3 includes a substantially fan-shaped bottom plate 3*a*, a first side plate 3*c* and a second side plate 3*d* which are extended upwardly from two sides of the bottom plate 3*a* and perpendicular to the bottom plate 3*a*, and an extension plate portion 3*b* which is extended from the wide end of the ray beam guiding box 1 and lies in the same plane as that of the bottom plate 3*a*. A detector support 11 provided with detector array (not shown) is disposed on the extension plate portion 3*b*.

As described above, the ray beam guiding portion (i.e. the inner space S surrounded by the bottom plate 3*a*, the first and second side plates 3*c*, 3*d*, and the upper cover 2) Of the ray beam guiding box 1 has a fan shape.

Preferably, a ray shielding layer 12 is disposed inside the ray beam guiding box 1, in other words, the ray shielding layer 12 is attached to the bottom plate 3*a*, the first and second side plates 3*c*, 3*d*, and the upper cover 2 respectively. A through aperture 14 is formed at a substantial center of the ray beam guiding box 1 so as to penetrate through the bottom plate 3*a* and the upper cover 2, and the through aperture 14 is preferably circular. The articles to be inspected, such as a bottle containing liquid can pass through the ray beam guiding box 1 via the through aperture 14, thereby the articles are inspected by the ray beam guided by the ray beam guiding box 1.

Figure 4:
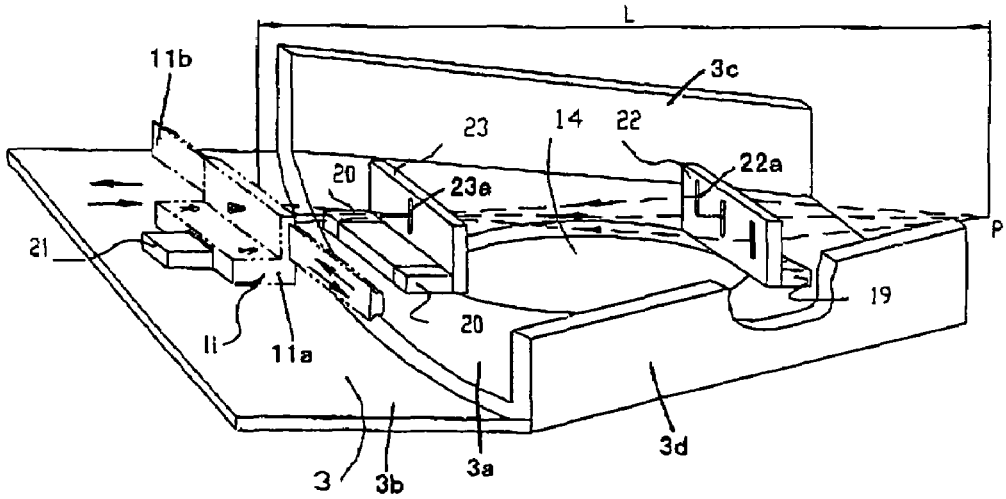
FIG. 4 is a principle view showing the calibration of the target spot of the ray generator.

Further, as shown in FIG. 4, a first boss 19 is disposed on the bottom plate 3*a* at one side (right side in FIG. 4) of the through aperture 14 adjacent to the narrow end, and adapted to engage and mount a first calibration member 22 having a calibration slit 22*a*.

A second boss 20 is disposed on the bottom plate 3*a* at the other side (left side in FIG. 4) of the through aperture 14 adjacent to the wide end and adapted to engage and mount a second calibration member 23 having a calibration slit 23*a*.

As shown in FIG. 4, the first calibration member 22 is inserted and engaged between two first bosses 19, and the second calibration member 23 is inserted and engaged between two second bosses 20, so that the first calibration member 22 and the second calibration member 23 can cooperate with each other to calibrate the rays emitted from the ray generator 7 and passing through the ray beam guiding box 1.

In the embodiment shown in FIG. 4, the first calibration member 22 has three vertical calibration slits 22*a* and the second calibration member 23 has one vertical calibration slit 23*a*, but the present invention is not limited to this, and the calibration slit 22*a* and the calibration slit 23*a* can be of any suitable number and can be horizontal.

At a side of the second boss 20 adjacent to the wide end of the ray beam guiding box 1, a third boss 21 is disposed on the extension plate portion 3*b*. The detector support 11 can be moved along the third boss 21 so as to adjust a distance L between the detector support 11 and a target spot P of the ray generator 7. The target spot P is a point where the rays are emitted. The detector support 11 has a support body 11*a* and a detector arm 11*b* which is moveable with respect to the support body 11*a* in the second direction. The detector arm 11*b* is provided with a detector array (not shown) for receiving the rays emitted from the ray generator 7.

Preferably, the first collimator 8, i.e. the right collimator in FIG. 1, comprises first and second sliding stoppers/blocks 9*a*, 9*b* which are engaged in a first slide groove (vertical slide groove in FIG. 1) 17*a* formed in the ray beam guiding box 1, and slidable in the first direction (upward and downward directions in FIG. 1) so as to adjust a first distance (a distance in the first direction) therebetween.

Further, the first collimator 8 comprises third and forth sliding stoppers/blocks 6*a*, 6*b* which are engaged in a second slide groove 17*b* (transversal slide groove in FIG. 1) formed in the ray beam guiding box 1, and slidable in the second direction (upward and downward directions in FIG. 2) perpendicular to the first direction so as to adjust a second distance (a distance in the second direction) therebetween. By adjusting the first distance between the first and second sliding stoppers 9*a*, 9*b* and the second distance between the third and forth sliding stoppers 6*a*, 6*b*, the profile, i.e. sizes/shapes, of the ray beam passing through the first collimator 8 in the first and second directions can be adjusted.

Preferably, the first distance between the first and second sliding stoppers 9*a*, 9*b* is adjusted by a first graduator 13, and the first graduator 13 is preferably in the form of a graduation rod and connected to the first and second sliding stoppers 9*a*, 9*b*. More particularly, the first graduator 13 is rotated, thereby the first and second sliding stoppers 9*a*, 9*b* slide along the first slide groove 17*a* so as to adjust the first distance therebetween.

Similarly, the second distance between the third and forth sliding stoppers 6*a*, 6*b* is adjusted by a second graduator 16, and the second graduator 16 is preferably in the form of a graduation rod and connected to the third and forth sliding stoppers 6*a*, 6*b*. More particularly, the second graduator 16 is rotated, thereby the third and forth sliding stoppers 6*a*, 6*b* slide along the second slide groove 17*b* so as to adjust the second distance therebetween.

Preferably, the ray beam guiding apparatus according to the present invention further comprises a first adjusting screw 18 disposed on the adjusting plate 5 so as to adjust a position of the ray generator 7 with respect to the ray beam guiding box 1 in the first direction (in upward and downward directions in FIG. 1), and a second adjusting screw 15 disposed on the adjusting plate 5 so as to adjust a position of the ray generator 7 with respect to the ray beam guiding box 1 in the second direction (in upward and downward directions in FIG. 2). However, the present invention is not limited to this, and the position of the ray generator 7 with respect to the ray beam guiding box 1 in the first and second directions can be adjusted by using any suitable adjusting means in the art.

Before using the ray beam guiding apparatus, the alignment between the target spot P of the ray generator 7 and the center of the detector array should be performed according to the relationship between the calibration slit 22*a* of the first calibration member 22 and the calibration slit 23*a* of the second calibration member 23.

As shown in FIG. 4, the first calibration member 22 having three vertical calibration slits 22*a* is inserted between two first bosses 19, and the second calibration member 23 having one vertical calibration slits 23*a* is inserted between two second bosses 20. According to the ray beam, the distance L between the detector array on the detector support 11 and the target spot P of the ray generator 7 is determined by moving the detector support 11 along the third boss 21. In addition, centering the detector array with respect to the ray beam is performed by moving the detector support arm 11*b* along the relative the detector support body 11*a*. After determining the position of the detector array, the ray beam guiding apparatus can be used, for example, to perform the ray inspection of a bottle containing liquid matter. Operations of inspecting the bottle are similar to those in the prior art, so that detailed descriptions thereof are omitted herein.

The above described ray beam guiding apparatus is applicable to a ray inspection system for ray-inspecting articles such as liquid articles. The other components and operations of the ray inspection system can be similar to those in the prior art, so that detailed descriptions of the ray inspection system are omitted herein.

Although several preferred embodiments have been shown and described, it would be appreciated by a person skilled in the art that changes can be made to the present invention without departing from its substantial spirit or essential principle. All the changes occurring within the scope of this invention or within the equivalent scope are included in this invention.

What is claimed is:

1. A ray beam guiding apparatus, comprising:

a ray beam guiding box which has substantially fan-shaped top and bottom surfaces, defines an inner space, and has open wide and narrow ends;

an engaging member joined to the narrow end of the ray beam guiding box;

a first collimator mounted to the ray beam guiding box adjacent to the narrow end and for adjusting a profile of the ray beam in a first direction and a second direction perpendicular to the first direction;

a second collimator having a calibration slit or grill and mounted to the ray beam guiding box adjacent to the wide end;

an adjusting member connecting the engaging member and a ray generator for emitting rays and for adjusting a distance between the ray generator and the ray beam guiding box;

wherein the ray beam guiding box comprises:

a lower box body, including:

a substantially fan-shaped bottom plate, first and second side plates extending upwardly from two sides of the bottom plate and perpendicular to the bottom plate, and an extension plate portion extending from the wide end of the ray beam guiding box and lying in the same plane as that of the bottom plate, in which a detector support with a detector array is disposed on the extension plate portion; and an upper cover covering a top of the lower box body.

2. The ray beam guiding apparatus according to claim 1, wherein a ray shielding layer is disposed inside the ray beam guiding box, and a through aperture is formed at a substantial center of the ray beam guiding box so as to penetrate through the bottom plate and the upper cover.

3. The ray beam guiding apparatus according to claim 2, further comprising:

a first boss disposed on the bottom plate adjacent to the narrow end, and for engaging and mounting a first calibration member having a calibration slit;

a second boss disposed on the bottom plate adjacent to the wide end, and for engaging and mounting a second calibration member having a calibration slit, in which the through aperture is located between the first and second bosses and the first and second calibration members being cooperated to calibrate the ray beam emitted from the ray generator and passing through the ray beam guiding box; and a third boss disposed on the extension plate portion and for engaging the detector support and adjust a distance between the detector support and a target spot of the ray generator, wherein the detector support has a support body and a detector arm moveable with respect to the support body.

4. The ray beam guiding apparatus according to claim 3, wherein the first collimator comprises:

first and second sliding stoppers which are engaged in a first slide groove formed in the ray beam guiding box, and slidable along the first slide groove in the first direction so as to adjust a first distance therebetween; and third and forth sliding stoppers which are engaged in a second slide groove formed in the ray beam guiding box, and slidable along the second slide groove in the second direction so as to adjust a second distance therebetween.

5. The ray beam guiding apparatus according to claim 4, wherein the first collimator further comprises:

a first graduator connected to the first and second sliding stoppers to adjust sliding of the first and second sliding stoppers along the first slide groove; and a second graduator connected to the third and forth sliding stoppers to adjust sliding of the third and forth sliding stoppers along the second slide groove.

6. The ray beam guiding apparatus according to claim 5, further comprising:

a first adjusting screw disposed on the adjusting plate to adjust a position of the ray generator with respect to the ray beam guiding box in the first direction; and a second adjusting screw disposed on the adjusting plate to adjust a position of the ray generator with respect to the ray beam guiding box in the second direction.

7. A ray inspection system comprising the ray beam guiding box according to claim 1.

* * * * *